US009789619B2

(12) United States Patent
Eljaouhari

(10) Patent No.: US 9,789,619 B2
(45) Date of Patent: Oct. 17, 2017

(54) FACIAL HAIR SHAVER WITH BUILT-IN FACIAL HAIR PATTERN GUIDES

(71) Applicant: Hasam Eljaouhari, San Antonio, TX (US)

(72) Inventor: Hasam Eljaouhari, San Antonio, TX (US)

( * ) Notice: Subject to any disclaimer, the term of this patent is extended or adjusted under 35 U.S.C. 154(b) by 0 days.

(21) Appl. No.: 15/151,235

(22) Filed: May 10, 2016

(65) Prior Publication Data

US 2016/0250762 A1 Sep. 1, 2016

Related U.S. Application Data

(63) Continuation-in-part of application No. 13/874,394, filed on Apr. 30, 2013, now abandoned, and a continuation-in-part of application No. 13/944,760, filed on Jul. 17, 2013, now abandoned.

(51) Int. Cl.

| | |
|---|---|
| ***A45D 27/42*** | (2006.01) |
| ***B26B 19/14*** | (2006.01) |
| ***B26B 21/40*** | (2006.01) |
| ***B26B 19/38*** | (2006.01) |

(52) U.S. Cl.

CPC ..... *B26B 21/4012* (2013.01); *A45D 27/42* (2013.01); *B26B 19/14* (2013.01); *B26B 19/388* (2013.01); *B26B 19/3853* (2013.01); *B26B 21/4043* (2013.01); *B26B 21/4081* (2013.01); *Y10T 83/04* (2015.04)

(58) Field of Classification Search

CPC ..... A45D 27/42; A45D 24/36; B26B 19/048; B26B 19/063; B26B 19/146; B26B 19/046; B26B 19/14; B26B 19/145; B26B 19/3853; B26B 19/388; B26B 21/4043

USPC ..... 30/34.1, 42, 43, 43.1, 43.2, 43.4, 43.5, 30/45, 45.6

See application file for complete search history.

(56) References Cited

U.S. PATENT DOCUMENTS

| | | | | |
|---|---|---|---|---|
| 2,542,450 A | | 2/1951 | Altman | |
| 2,765,797 A | * | 10/1956 | Potente | A45D 24/36 132/213 |
| 2,804,684 A | | 9/1957 | Talamonti | |
| 2,972,351 A | * | 2/1961 | Morgan | B26B 19/00 132/213 |
| 3,055,376 A | * | 9/1962 | Walls | A45D 24/36 132/213 |

(Continued)

FOREIGN PATENT DOCUMENTS

| | | |
|---|---|---|
| EP | 0613631 | 9/1994 |
| EP | 1215020 | 9/2002 |

(Continued)

*Primary Examiner* — Stephen Choi
*Assistant Examiner* — Evan Macfarlane
(74) *Attorney, Agent, or Firm* — Buche & Associates, P.C.; John K. Buche; Bryce A. Johnson

(57) ABSTRACT

A shaving apparatus with a canopy with a nose guard and chin guard; at least one cutting mechanism disposed on a track within the canopy, wherein the track is configured to define the outline of a beard style; and at least one motor for (a) operating the cutting mechanism(s) and (b) shifting the position of the cutting mechanism(s) around the track. The apparatus may be positioned utilizing the canopy's features. The cutting mechanisms may be spring mounted rotary blades that are pressed against the user's face.

7 Claims, 13 Drawing Sheets

(56) References Cited

U.S. PATENT DOCUMENTS

| | | | | |
|---|---|---|---|---|
| 3,115,143 | A * | 12/1963 | Queen | A45D 24/36 132/213 |
| 3,233,614 | A * | 2/1966 | Lefcoski | B26B 19/02 132/213 |
| 3,264,734 | A | 8/1966 | Starre | |
| 3,272,209 | A * | 9/1966 | Kraus | A45D 24/36 132/213 |
| 3,413,985 | A | 12/1968 | Dlouhy | |
| 3,678,944 | A * | 7/1972 | Berry | B26B 19/00 132/213.1 |
| 3,858,589 | A | 1/1975 | Geiger | |
| 3,870,055 | A | 3/1975 | Barbarow | |
| 4,038,747 | A | 8/1977 | Upton | |
| 4,150,483 | A | 4/1979 | Kanazawa | |
| 4,602,542 | A * | 7/1986 | Natrasevschi | B26B 19/00 132/214 |
| 5,865,192 | A * | 2/1999 | Sealy | B26B 29/06 132/214 |
| 6,418,623 | B1 | 7/2002 | Marcarelli | |
| 6,553,680 | B2 | 4/2003 | Vazdi | |
| 6,584,691 | B1 * | 7/2003 | Gerasimov | B26B 19/14 30/346.51 |
| 6,655,389 | B2 | 12/2003 | Bertucci | |
| 7,188,422 | B2 | 3/2007 | McCambridge | |
| 7,530,171 | B2 | 5/2009 | Baron et al. | |
| 8,082,927 | B2 | 12/2011 | Bonge | |
| D662,258 | S | 6/2012 | Chapman | |
| 8,826,922 | B1 * | 9/2014 | Lewis | A45D 27/42 132/213 |
| 2004/0074511 | A1 | 4/2004 | Sussan | |
| 2005/0216035 | A1 * | 9/2005 | Kraus | B26B 19/388 606/133 |
| 2008/0092393 | A1 | 4/2008 | Van Der Meer | |
| 2009/0223530 | A1 | 9/2009 | Chapman | |
| 2012/0234146 | A1 * | 9/2012 | Lakin | B26B 19/00 83/76.2 |
| 2014/0200734 | A1 * | 7/2014 | Krenik | G05B 15/02 700/302 |
| 2015/0020658 | A1 * | 1/2015 | Eljaouhari | B26B 19/388 83/13 |
| 2016/0263755 | A1 * | 9/2016 | Uit De Bulten | B26B 21/4081 |

FOREIGN PATENT DOCUMENTS

| | | |
|---|---|---|
| EP | 0955824 | 11/2002 |
| GB | 2441122 | 2/2008 |
| WO | WO2007129772 | 11/2007 |
| WO | WO2010134794 | 11/2010 |
| WO | WO2011084130 | 7/2011 |

* cited by examiner

FACIAL HAIR SHAVER WITH BUILT-IN FACIAL HAIR PATTERN GUIDES

CROSS-REFERENCE TO RELATED APPLICATIONS

This Application is a continuation-in-part of U.S. patent application Ser. No. 13/874,394 filed on Apr. 30, 2013, entitled "Facial Hair Shaver With Built-in Facial Hair Pattern Guides."

STATEMENT REGARDING FEDERALLY SPONSORED RESEARCH OR DEVELOPMENT

Not applicable.

BACKGROUND OF THE INVENTION

Field of Invention

This invention is in the field of guarded or guided facial hair trimmers.

Background of the Invention

A beard is a grouping or groupings of facial hair that grow on the chin, upper lip, cheeks or neck of male humans. Throughout time, beard sporting males have been attributed with various qualities such as wisdom, sexual virility or masculinity. In modern times, various beard styles have developed as elements of fashion or non-verbal expression. Exemplary styles include: a mustache, which is defined by a tuft of hair on the upper lip of an otherwise clean shaved face; a goatee, which is defined as a tuft of hair on the chin of an otherwise clean shaved face; and a Van Dyke, which is defined as a mustache plus goatee on an otherwise clean shaved face. In modern parlance, the term goatee may refer to a goatee or a Van Dyke beard style.

In view of constantly growing facial hair, men are occasionally desirous of either repeating a particular beard style or changing their beard to a new style. Usually, repeating or changing a beard style is accomplished by free hand grooming of the beard using a shaver. Problems arise in free hand grooming because untrained beard groomers ordinarily cannot consistently (a) repeat an old beard style or (b) arrive at a desired new beard style from a preexisting one. Thus, a need arises for apparatus and related methods of consistently accomplishing a desired new or old beard style of a wearer.

In view of the forgoing, various guards and stencils exist, whether alone or in combination, for controlling the length and shape of facial hair tufts that compose a beard. For example, U.S. Pat. No. 6,655,389, U.S. Pat. No. 8,082,927, U.S. Des. Pat. No. D662258, U.S. Pub. Pat. App. No. 2009/0223530, and P.C.T. Pub. App. No. WO2010/134794 disclose various embodiments of stencils or guides for facial hair shavers. However, such known stencils/guides are not adequately suited for grooming all beard styles. First, many of the devices are not adapted to guard facial features that might otherwise be exposed to injury by hair cutting razors. Second, all of the devices do not have built-in razors so that the same must used in connection with a non-stationary and free-hand razor. Finally, none of the devices feature adjustment mechanisms for altering the stencil or guard to the particular face of a user. Thus, a need still exists for apparatus and related methods of consistently accomplishing a desired new or old beard style of a wearer without the drawbacks of known stencils or guides.

SUMMARY OF THE INVENTION

Accordingly, it is an object of the present invention to provide apparatus and related methods of consistently accomplishing a desired new or old beard style. It is another object of the present invention to provide such apparatus and related methods in a manner that protects facial features that are otherwise exposed to injury by razors. Yet still, it is an object of the present invention to disclose such apparatus and related methods wherein the apparatus have built in razors with adjustment mechanisms for adapting facial hair patterns to the particular face or preference of a user.

In one embodiment, the disclosed apparatus comprises: a canopy with a nose guard and chin guard; at least one cutting mechanism disposed on a track within the canopy, wherein the track is configured to define the outline of a beard style; and at least one motor for (a) operating the cutting mechanism(s) and (b) shifting the position of the cutting mechanism(s) around the track. In operation: (1) the apparatus may be stagnantly placed over the mouth area so that the nose guard is positioned beneath the nostrils of a user and so that the chin guard is placed (or cupped) against the user's chin; (2) the motors may be turned-on whereby the cutting mechanism(s) operate while traversing the track to shape the beard style; and (3) the motors may continue to run so that the cutting mechanism(s) may repeatedly move back and forth along the track until the beard style is completed. In a preferred mode of operation, the tracks may be adjusted to fit the contours and size of the user's face. In one embodiment, the nose and chin guards may be preferably spring mounted and adjustable so that depth of the shape may be adjusted to the user's face. In yet another embodiment, the cutting mechanisms may be defined by three spring mounted rotary blades on a spring mounted track, wherein the rotary blades may be pressed against the users face. In other embodiments, different spring-mounted cutting mechanisms, such as straight razors or lasers, may be utilized along the track.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which.

Figure 1A:
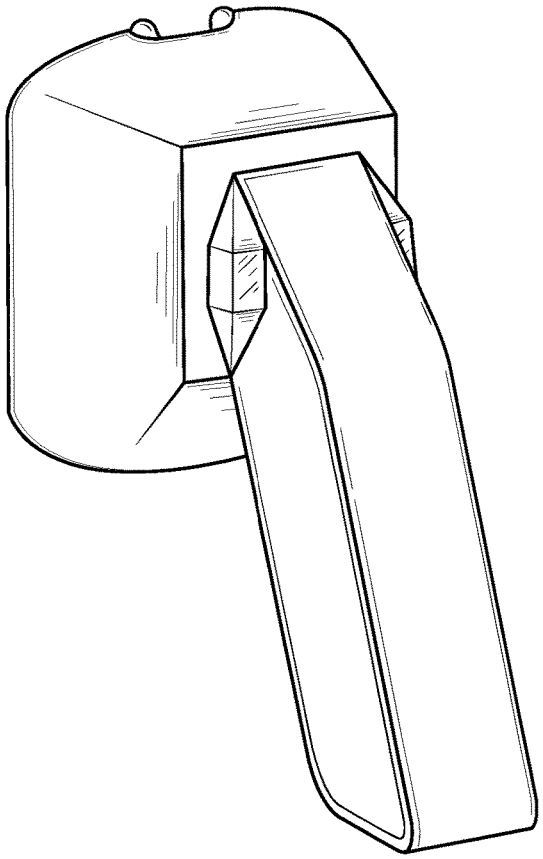
FIG. 1A is a perspective view of a beard styling apparatus.
Figures 1B, 2, 3:
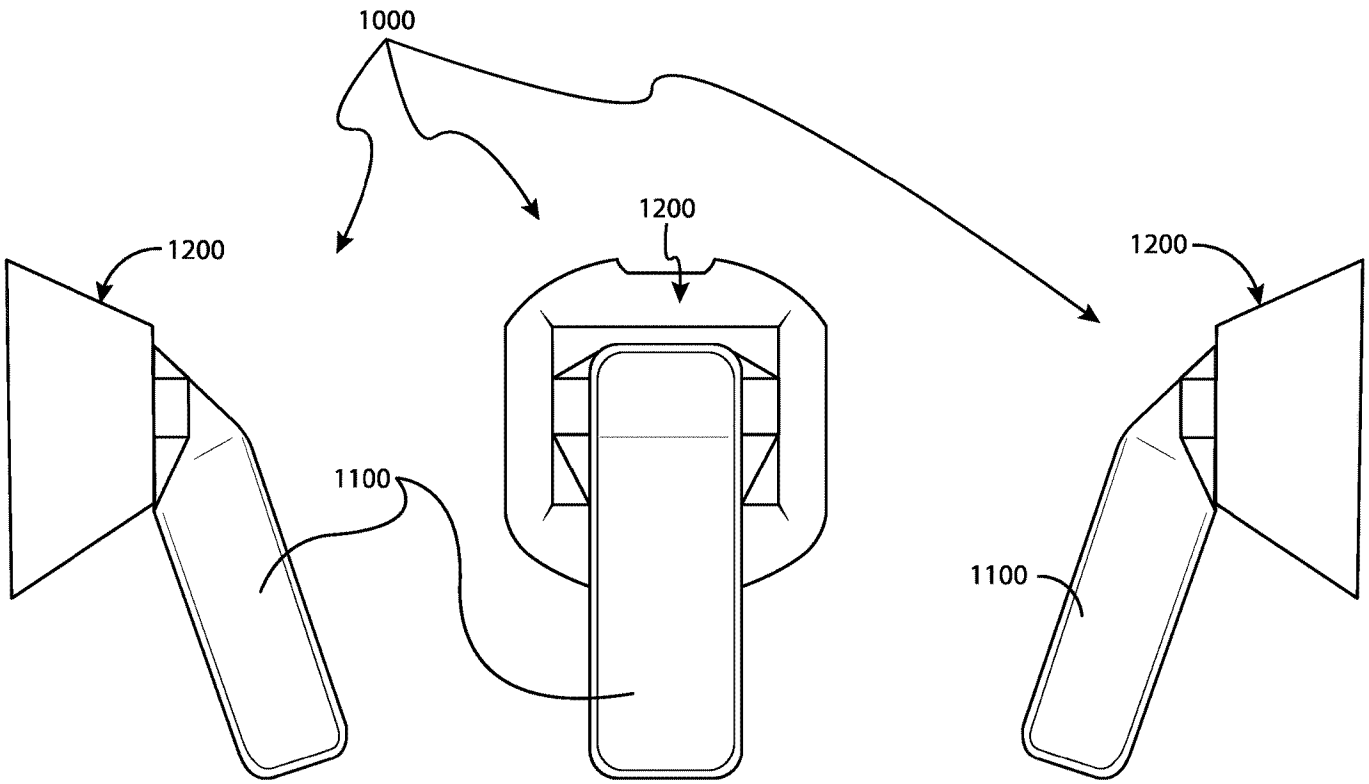
FIG. 1B is a right side view of beard styling apparatus.
FIG. 2 is a front view of a the beard styling apparatus.
FIG. 3 is a left-side view of the beard styling apparatus.

It is to be noted, however, that the appended figures illustrate only typical embodiments of the disclosed apparatus and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed are apparatus and related methods of consistently accomplishing a desired new or old facial hair style. The disclosed apparatus and related methods accomplish said facial hair styles in a manner that protects facial features which would otherwise be exposed to injury by hair cutting mechanisms. Yet still, the disclosed apparatus have built in razors with adjustment mechanisms for adapting facial hair patterns to the particular face or preference of a user.

In general, the disclosed apparatus comprises: a canopy that houses (i) a nose guard for supporting and aligning the apparatus to the nostrils and upper lip of a user, (ii) a chin guard for stabilizing and supporting the apparatus to the chin of the user, and (iii) a track that supports at least one cutting mechanism, wherein the track is configured to define the outline of a beard style; and at least one motor for (a) operating the cutting mechanism(s) and (b) shifting the position of the cutting mechanism(s) along the track. The more specific features of the apparatus are further disclosed in connection with the figures.

FIGS. 1A through 4 respectively depict a perspective view, a right side view, a front view, a left-side view, and a back view of one embodiment of a preferred beard styling apparatus 1000. Referring to said figures, the apparatus 1000 features: a handle 1100 with an internal motor 1110 (See FIG. 14); a canopy 1200; a nose guard 1300; a chin guard 1400; a spring mounted track 1500 with three spring mounted rotary blades 1510 that are movably secured to the track 1500. The canopy 1200 is preferably a firm yet slightly flexible structure (e.g., made from hard rubber or plastic like substances). In use, the canopy 1200 may encompass the cutting area of the device and, as discussed in greater detail below, is configured to sit stationary against the face of a user. Preferably, the canopy 1200 further houses (i) the nose guard 1300 so that the nose guard may support and align the apparatus to the nostrils and upper lip of a user, (ii) the chin guard 1400 for stabilizing and supporting the apparatus to the chin of the user, and (iii) the track 1500 that supports the rotary blades 1510, wherein the track 1500 is spring mounted and configured to define the outline of a beard style. Suitably, the spring mounted rotary blades 1510 are configured for compression against the face of a user during operation, wherein the blades are spring mounted so that the blades may be continually placed flush against the face of a user and wherein the track is spring mounted so that the blades may be aligned or adjusted to the contours of the user's face. As discussed in further detail below, the motor 1110 (See FIG. 14) is disposed within the handle 1100 and is coupled to the rotary blades 1510 to drive both the rotation of the rotary blades 1510 and movement of the same 1510 along the track 1500. In an alternative embodiment, the rotary blades 1510 may be equipped with micro motors for each blade, wherein the micro motors rotate the blade. As described later, motion of the rotary blades may be driven by, for instance, a series of gears with teeth, springs, and other mechanisms. Such coupling of the motor to the blades for rotational and track movement will be well known to those of skill art.

Figure 5:
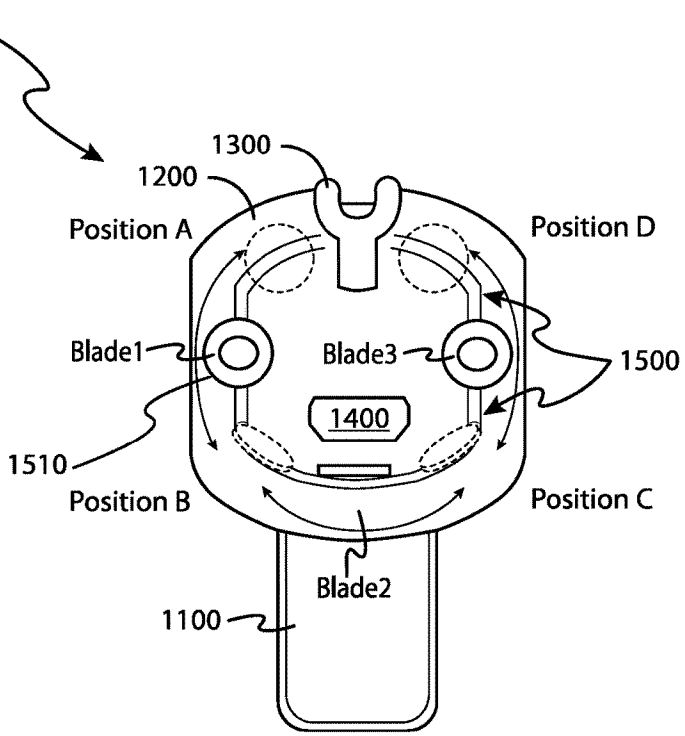
FIG. 5 is an operational display of the back view of the beard styling apparatus.
Figure 4:
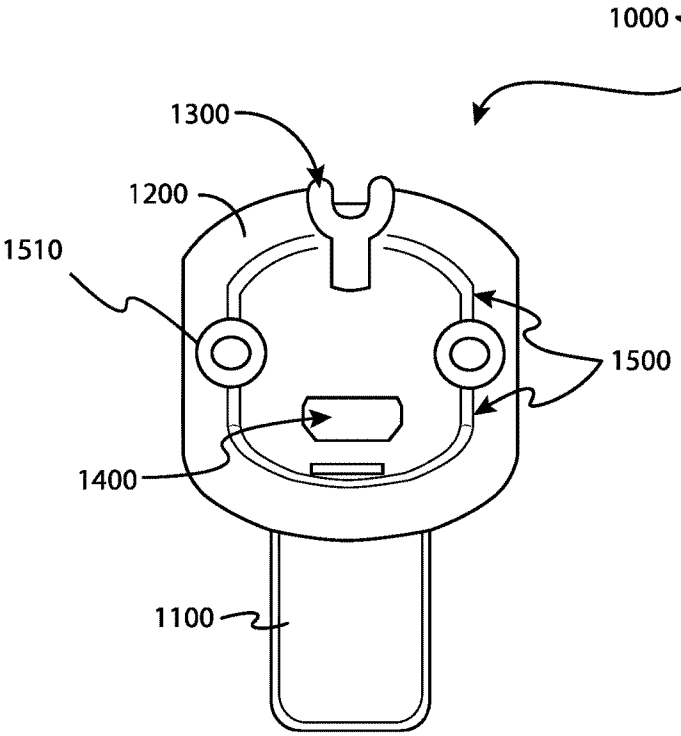
FIG. 4 is a back view of the beard styling apparatus.

FIG. 5 is an operational display of the back view of the beard styling apparatus. More specifically, FIG. 5 is an illustration of a preferred mode of operation for the rotary blades 1510 of the apparatus, wherein each blade oscillates between two of four positions on the tracks. In one embodiment: a first rotary blade, Bade1, oscillates along the track 1500 between position A and B shown in broken lines; a second rotary blade, Blade2, oscillates along the track 1500 between positions B and C shown in broken lines; and a third rotary blade, Blade 3 oscillates along the track 1500 between positions C and D shown in broken lines. Suitably, the first, second and third blades Blade1, Blade2, Blade3 would be in sync such that: (a) the first blade is in position A while the second blade is in position B and the third blade is in position C; and (b) the first blade is in position B while the second blade is in position C and the third blade is in position D. While oscillating, it is contemplated that the blades 1510 are also rotating to cut facial hair passed over during said oscillations. In a preferred embodiment, the oscillations of the first through third blades overlap (e.g., B and C define overlapping positions). As discussed above, the motor 1110 (See FIG. 14) is configured to drive the oscillations of the blades 1510.

Figure 6:
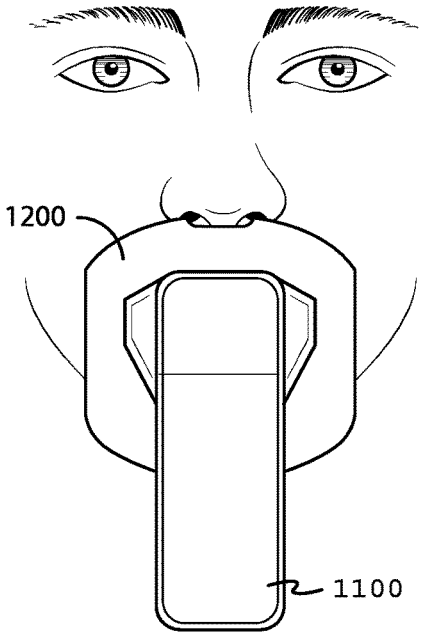
FIG. 6 is an environmental view of the beard styling apparatus.

FIG. 6 is an environmental view of the beard styling apparatus 1000. Specifically, the figure illustrates the front view of the apparatus 1000 as it is preferably placed against the face of a user in the operating position. As discussed in greater detail below, once the apparatus 1000 is placed along the user's face, as shown, the apparatus 1000 preferably does not move after being turned on because the blades are moving internally relative to the user's face. To avoid any disruption in the beard style pattern created by the apparatus, the lips and mouth of the user should remain still while the apparatus 1000 is on. In a preferred embodiment, the rotary blades 1510 feature protective covers, wherein the rotary blades 1510 can be placed flush against the skin without the blades cutting the skin. In a preferred use, the apparatus 1000 is placed over a user's mouth and chin, wherein the rotary blades can be felt flush against the skin. In a preferred embodiment, the mouth area may include at least a portion of at least one of a user's nose, lip, and chin.

Figure 7:
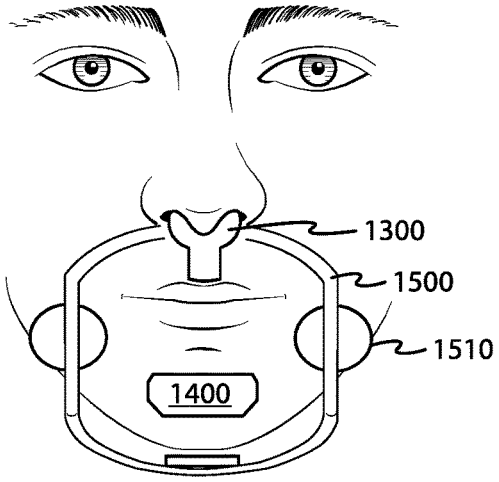
FIG. 7 a schematic diagram showing blades and a track positioned on a face.

FIG. 7 a schematic diagram showing the blades 1510 and a track 1500 being positioned on a face of a user. The figure illustrates how the tracks 1500 (guiderails) are preferably positioned when the apparatus 1000 is placed against the face of a user, in an operating position. The figure also shows how the nose guard 1300 and chin guard 1400 are preferably positioned along the face to stationarily stabilize the apparatus 1000 against the face. The apparatus must be aligned against the face (prior to turning the electric shaver on) with the nose guard positioned against the nostrils and upper lip indentation as indicated. More specifically, the chin guard 1400 may suitably be placed against the user's chin while the nose guard 1300 is positioned under the nostrils of the user's nose so as to center the apparatus 1000 and stabilize the same against the user's face. Once the chin and nose guards 1400, 1300 are so positioned, the apparatus 1000 may suitably remain stagnant, held in place by the individual's hand, and compressed against the user's face. After stabilization of the apparatus 1000, the apparatus can be turned on, allowing the oscillating and rotary blades to move along the tracks and cut facial hair automatically in their path.

Figures 8A, 8B:
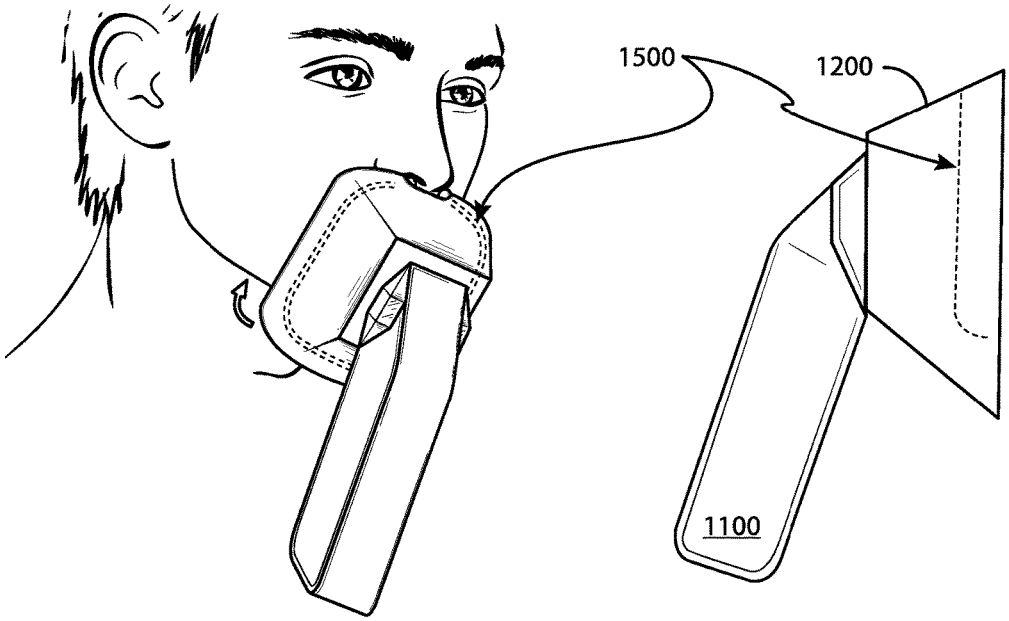
FIG. 8A is a schematic diagram showing a track positioned on a face.
FIG. 8B is a side view showing a track positioned within the apparatus.
Figure 11:
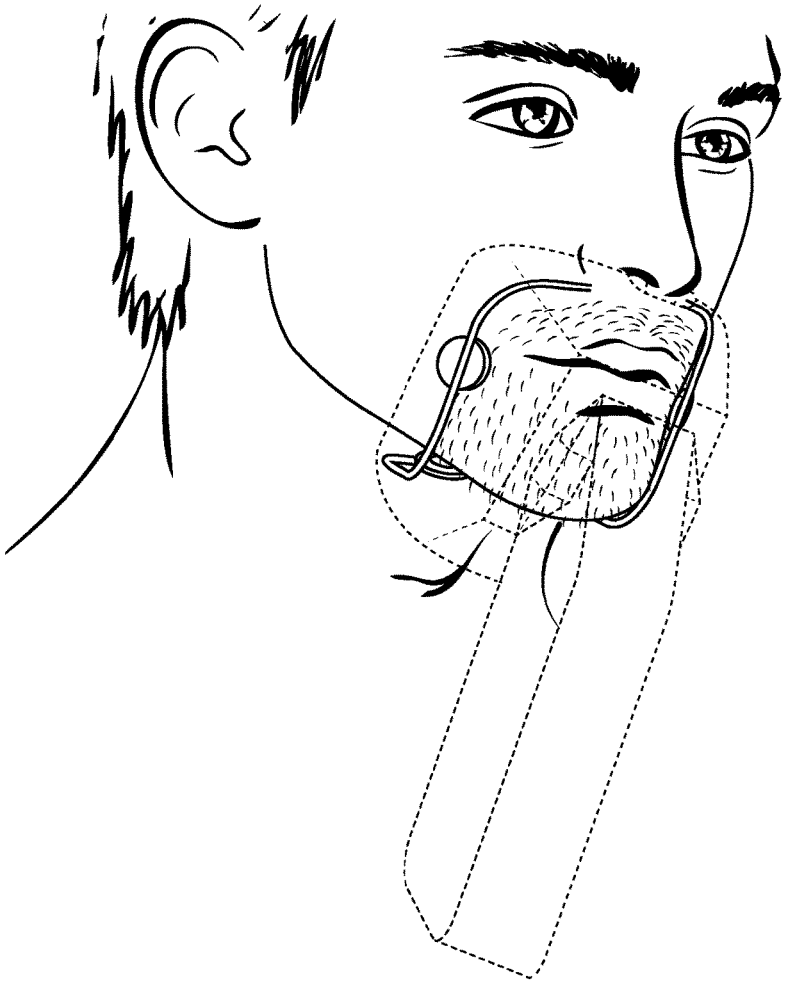
FIG. 11 is a perspective view of the track as positioned on a face.
Figure 12:
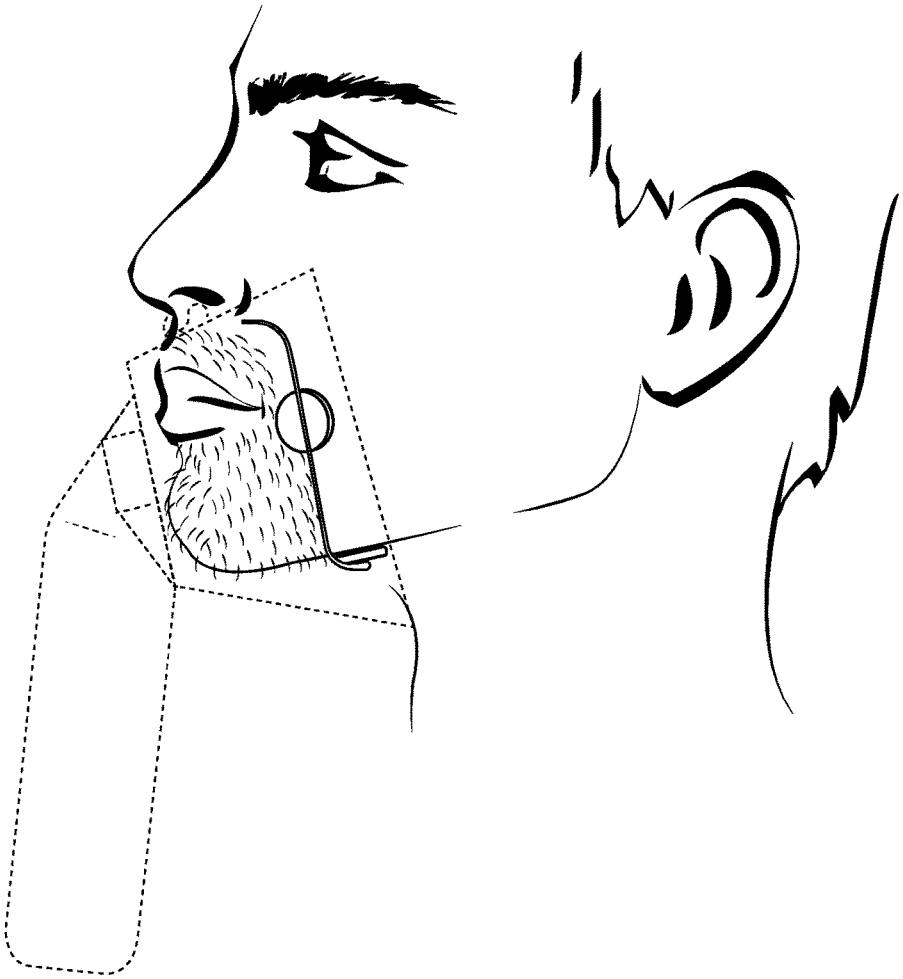
FIG. 12 is a side view of the track positioned on the face.

FIGS. 8A and 8B are another schematic diagram showing a track positioned on a face. As shown the track 1500 may be suitably formed or configured to adjust to the contours of a face. FIGS. 11 and 12 further illustrate that, in the preferred embodiment, the track is designed to contour under the user's chin so that the blade may remain flush against the skin on the underside of the chin and according to the beard style pattern.

Figure 9:
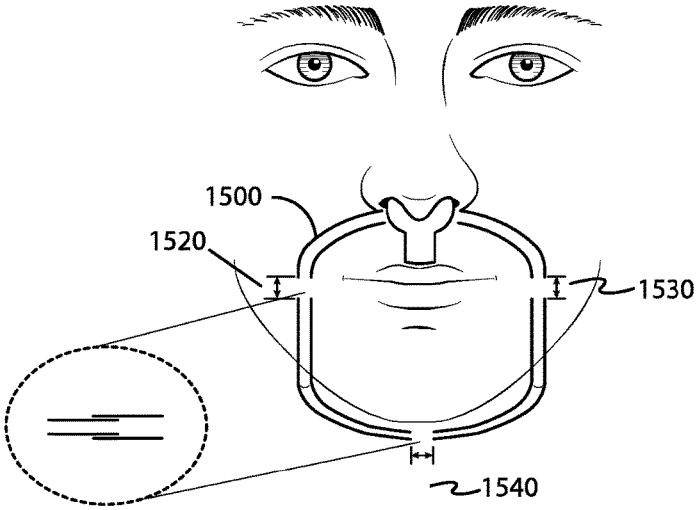
FIG. 9 is yet another schematic diagram showing a track positioned on a face.

FIG. 9 is yet another schematic diagram showing a track positioned on a face. As shown, the track 1500 may suitably be widened and lengthened to fit the dimensions of a specific user's face. FIG. 9 illustrates how the tracks 1500 (guiderails) would be positioned when the apparatus is placed against the face, in the operating position. In a preferred embodiment, the track 1500 features three adjustment points, 1520, 1530, 1540 wherein sectioned rails of the track may slide relative to other rails to accomplish adjustment. In operation, the first two adjustment points 1520, 1530 (working in unison) are suitably for elongating the track 1500 while the third adjustment point 1540 is suitably for widening the track. Such elongation or widening of the track allow a user to adjust the track 1500 to the user's facial dimensions or beard style preferences. Suitably, the actual adjustment mechanism can be done in a number of ways, for example, using a threaded rotating screw-like mechanism to bring the guiderails closer together or further apart or a mechanism with latching teeth to allow for a number setting, clicking each latch to bring the guiderails closer or further apart, locking into the teeth.

Figure 10:
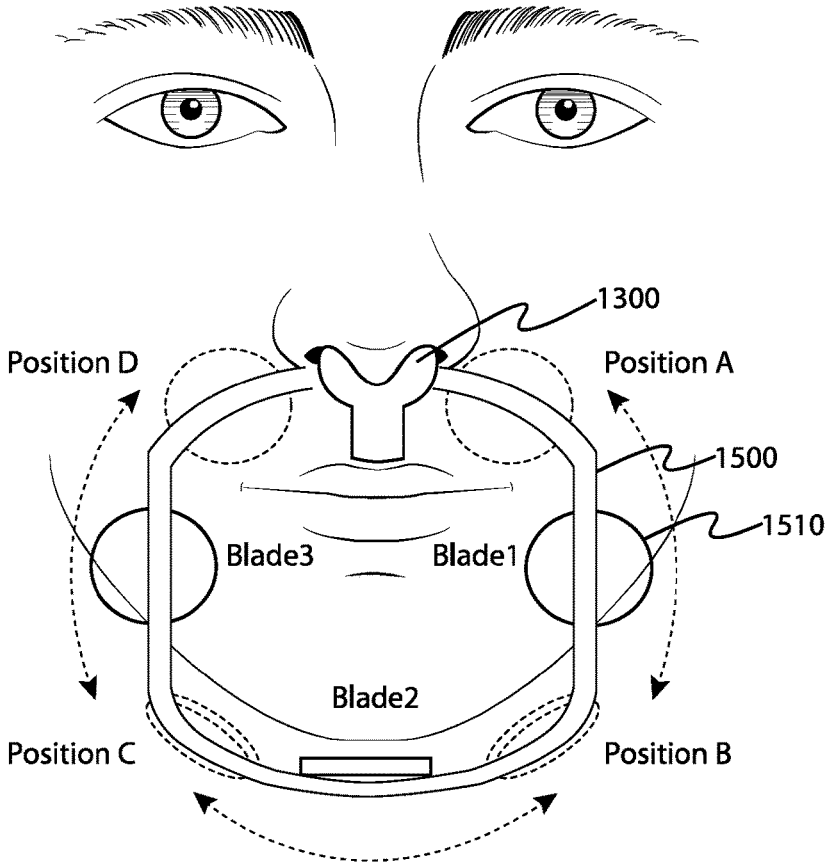
FIG. 10 is an operational and schematic view of blades and a track positioned on a face.

FIG. 10 is an operational and schematic view of blades and a track positioned on a face. Prior to operation: (1) the track 1500 may suitably be adjusted to the dimensions of the user's face or beard style preference; (2) the apparatus may be stationarily placed over the mouth area so that the nose guard is positioned beneath the nostrils of a user and so that the chin guard is placed (or cupped) against the user's chin. In operation, (1) the motor may be turned-on whereby the cutting mechanism(s) operate while traversing the track to shape the beard style; and (2) the motor may continue to run so that the cutting mechanism(s) may repeatedly move back and forth along the track until the beard style is completed.

Figure 13:
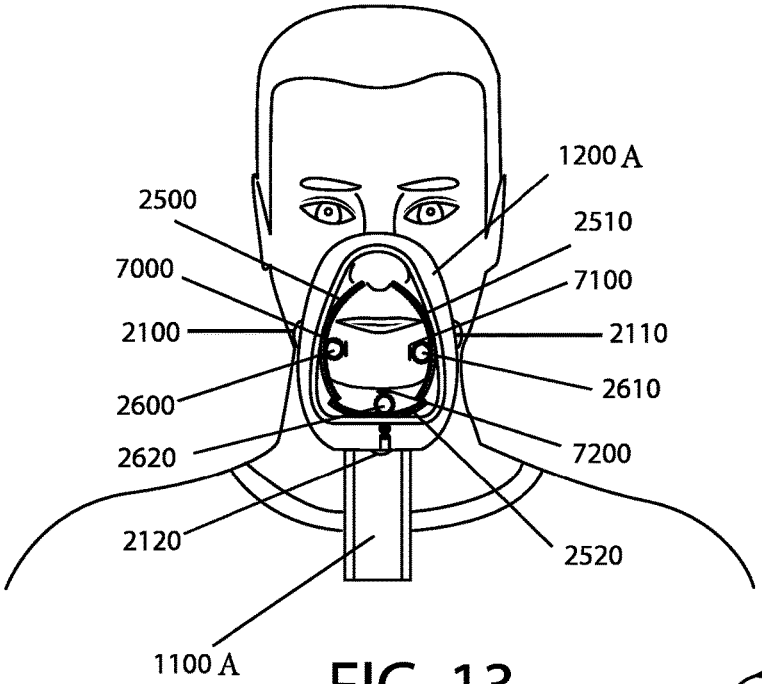
FIG. 13 is an environmental view of one embodiment of the facial hair shaving apparatus.

FIG. 13 is an environmental view of one embodiment of the facial hair shaver with the canopy center removed to show a portion of the inner mechanisms. Referring to FIG. 13, this embodiment is designed for shaving the outline of a goatee. In one embodiment, the goatee shaving apparatus of FIG. 13 features: (a) at least one rotary motor 1110 (See FIG. 14) housed in the handle 1100A; (b) exterior track adjustment knobs 2100, 2110, 2120; (c) an inlet 2200 for a user's nose; (d) rotary gears 2600,2610, 2620; and, (e) exterior tracks 2500, 2510, 2520.

Figure 14:
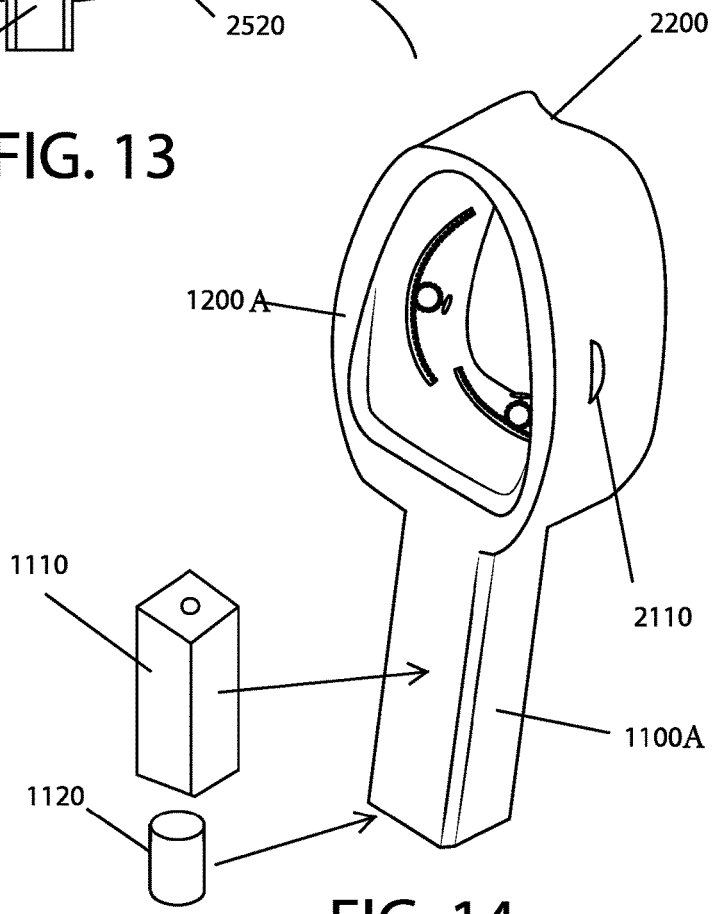
FIG. 14 is a perspective view of the facial hair shaving apparatus of FIG. 13.

FIG. 14 is a perspective view of one embodiment of the goatee shaving apparatus of FIG. 13 with the canopy center removed, which shows an exterior track adjustment knob 2110, a rotary motor 1110 that is housed in the handle 1100A, and the inlet 2200 for a user's nose. In use, a user may scroll the exterior track adjustment knobs 2100, 2110, 2120 to adjust the exterior tracks 2500, 2510 to widen or narrow and exterior track 2520 to raise or lower to fit a user's face. The exterior track adjustment knobs 2100, 2110, 2120 are preferably adjusted before the apparatus is switched on and, preferably, may not be adjusted during operation of the goatee shaving apparatus. In one embodiment, the rotary motor 1110 may be powered by a battery 1120, which may be rechargeable, or powered by an electrical outlet.

Figure 15:
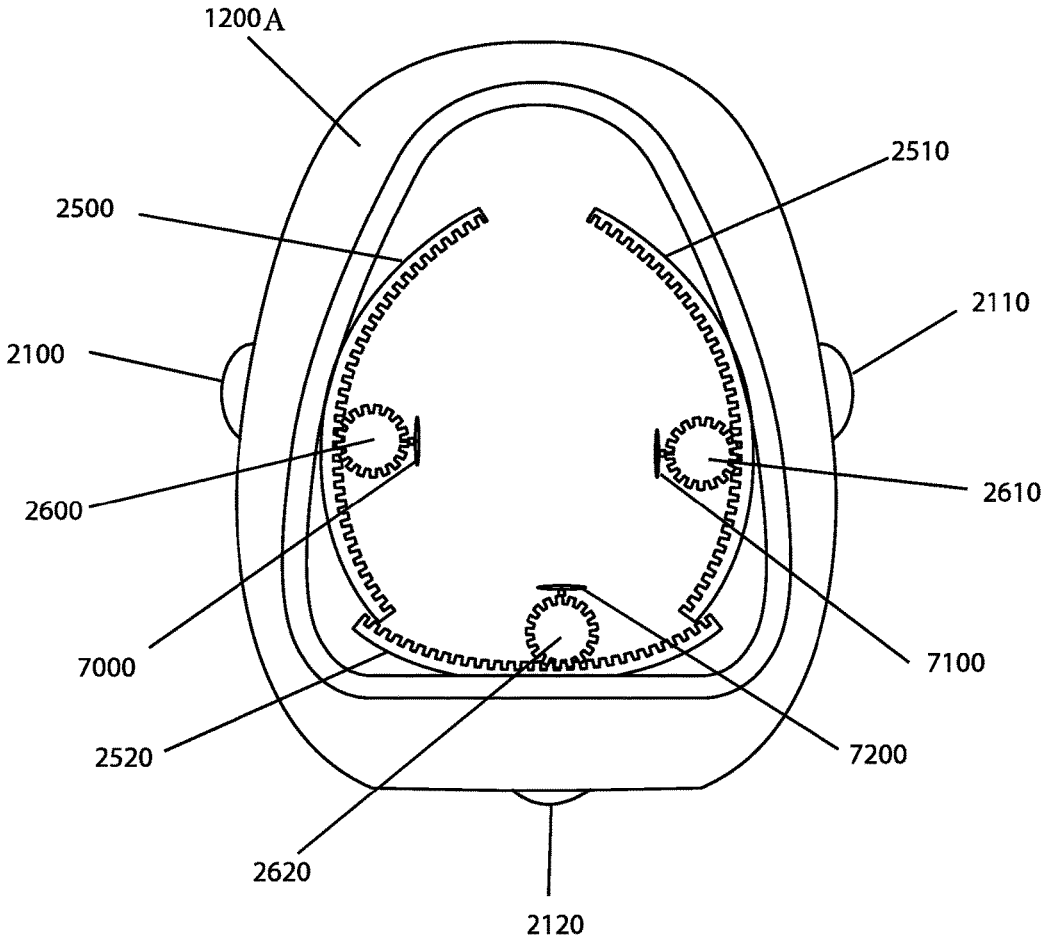
FIG. 15 is a front view of the facial hair shaving apparatus of FIG. 13.

FIG. 15 is a front view of one embodiment of the goatee shaving apparatus of FIG. 13 with the canopy center removed. Referring to FIG. 15, the goatee shaving apparatus of FIG. 13 may feature one embodiment of a canopy 1200A, tracks 2500, 2510, 2520, rotary gears 2600, 2610, 2620, rotary blades 7000, 7100, 7200, and track adjustment knobs 2100, 2110, 2120. In a preferred embodiment, the goatee shaving apparatus is placed over and around the mouth area of a user. This area is may be comprised of the user's lips, the bottom portion of the user's nose, and the user's chin and may also include at least a portion of at least one of a user's nose, lip, and chin. When positioned over the mouth area, the rotary blades 7000, 7100 are flush against the user's skin to the left and right of the user's lips respectively, and rotary blade 7200 is flush against the user's skin on the underside of the user's chin.

Figure 16:
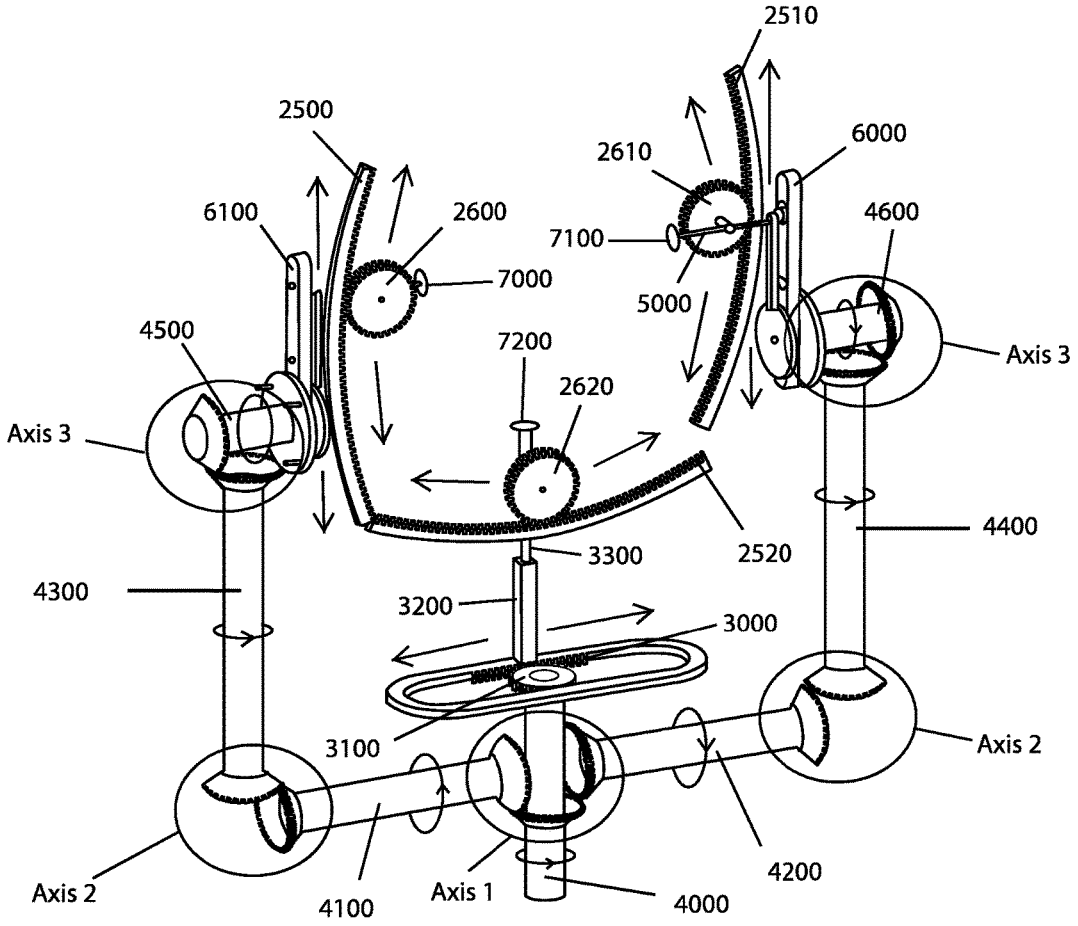
FIG. 16 is a perspective view of one embodiment of the inner mechanisms of the facial hair shaving apparatus of FIG. 13.

FIG. 16 is a perspective view of one embodiment of the inner mechanisms of the facial hair shaving apparatus of FIG. 13 without the canopy, housing, and handle surrounding the inner mechanisms. FIG. 16, in one embodiment, depicts the transfer of motion and oscillation within the facial hair shaving apparatus. The inner mechanisms of the facial hair shaving apparatus may be comprised of: a plurality of rotational shafts 4000, 4100, 4200, 4300, 4400, 4500, 4600 with bevel gears; a plurality of support shafts 3200, 3300, 5000 (support shaft behind gear 2600 is not shown or labeled); two crankshafts 6000, 6100, a rack 3000 and pinion gear 3100; three rotary gears 2600, 2610, 2620; for oscillation, rotary blades 7000, 7100, 7200; and, a plurality of axes. The rotary motor 1110 (See FIG. 14) in the handle is in communication with rotational shaft 4000, which when the motor 1110 is turned on triggers the movement and oscillation of all other shafts and gears.

Figure 17:
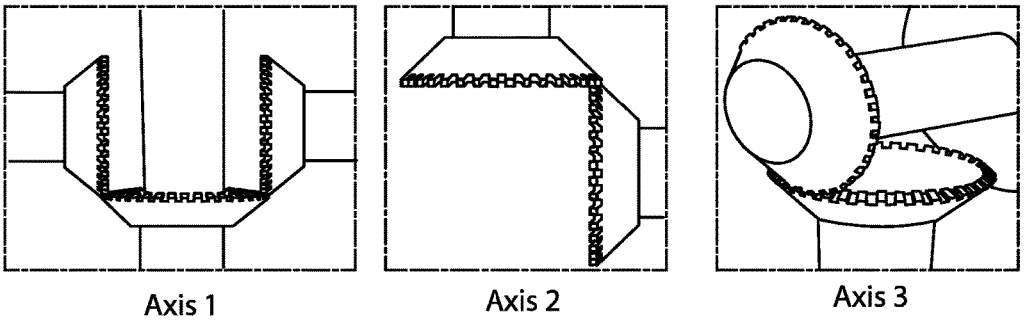
FIG. 17 is a close-up view of one embodiment of different axes of the inner mechanism of the facial hair shaving apparatus of FIG. 13.

FIG. 17 is a close-up view of the axes of the inner mechanisms that transfer rotational movement from one rotational shaft to another. In one embodiment, the axes are powered by the rotary motor 1110 in the handle and, in turn, create the back and forth or up and down movement of the gears along the exterior tracks. Referring to FIG. 17, a series of beveled gears are employed throughout the inner mechanism to transfer motion from a single rotary motor 1110 to the three different axes. Referring to FIG. 16: Axis 1 is the junction of rotational shafts 4000, 4100, and 4200; Axis 2 is the junction of rotational shafts 4100 with 4300 and 4200 with 4400; and, Axis 3 is the junction of rotational shafts 4300 with 4500 and 4400 with 4600.

Figure 18:
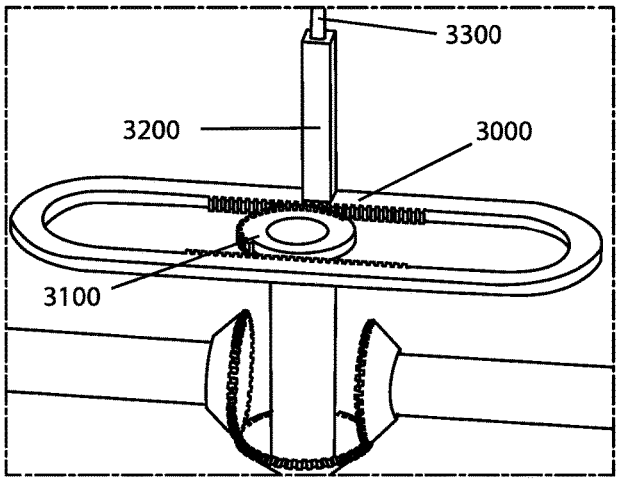
FIG. 18 is a close-up view of one embodiment of a rack and pinion mechanism of the facial hair shaving apparatus of FIG. 13 that transfers rotational motion into a back and forth reciprocating motion.

FIG. 18 is a close-up view of one embodiment of the facial hair shaving apparatus, in which rotational motion is transferred to a back and forth reciprocating motion using a rack and pinion gear. Referring to FIG. 18, in one embodiment, the gear 2620 (See FIG. 16) is able to move back and forth on track 2520 (See FIG. 16) via the shafts 3200, 3300, and a pinion 3100 and rack 3000 gear. In one embodiment, the pinion 3100 features (1) gear teeth on only one half of the circular gear and (2) the corresponding rack 3000 features two sets of gear teeth located on opposite sides from each. The teeth on the rack interact with the corresponding gears on the pinion 3100. In use, in one embodiment, as the rotary motor 1110 rotates the shaft 4000 (See FIG. 16), the attached pinion 3100 will move the rack 3000 back and forth as the gear teeth on the pinion 3100 interact with the gear teeth on either side of the rack 3000. Referring to FIGS. 16 and 18, the support shaft 3200 is attached to the rack 3000 and support shaft 3300. Support shaft 3300 may be spring mounted (see spring 3301 in FIG. 20) to rotary gear 2620 (See FIG. 16), so that when the rack 3000 travels back and forth, the shaft 3200 moves the spring mounted rotary gear 2620 back and forth along the curved track 2520 (See FIG. 16). Additionally, because there is a spring on the support shaft 3300, the rotary gear 2620 (See FIG. 16) is able to move slightly up and down to adapt to and correspond with the elevation changes it experiences as it travels along the curved track 2520 (See FIG. 16). Also, located on the end of support shaft 3300 is a rotary blade 7200. Thus, as the motor 1110 rotates shaft 4000 at axis 1, the rack 3000 moves back and forth via the pinion gear 3100, and accordingly, the shaft 3200 moves the gear 2620 (See FIG. 16), which may be spring mounted on shaft 3300, back and forth along the track 2520 (See FIG. 16), contributing to the oscillation motion. During this process, the blade 7200 moves back and forth along the underside of a user's chin.

Figure 19:
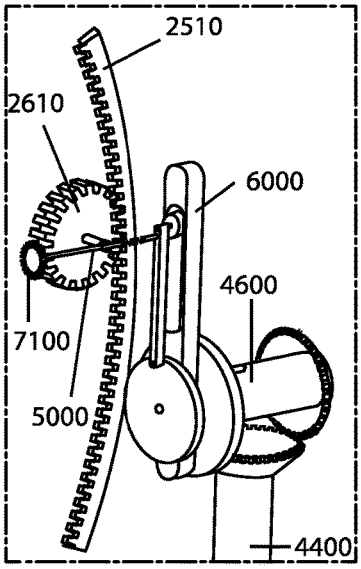
FIG. 19 is a close-up view of one embodiment of a crank and shaft mechanism of the facial hair shaving apparatus of FIG. 13 that converts rotational motion to reciprocating motion.

FIG. 19 is a close-up view of one embodiment of the crankshaft mechanism of the facial hair shaving apparatus. Referring to FIG. 19, a crankshaft 6000 is attached to rotational shaft 4600 and converts rotational motion to an up and down reciprocating motion. The crankshaft 6000 is attached to support shaft 5000, which is attached to a gear 2610 and a blade 7100 and may be spring loaded to allow the gear 2610 to travel along the curved track 2510. In use, as the rotary motor 1110 rotates rotational shafts 4000 and 4200, the beveled gears will cause rotational shaft 4400 to rotate. Rotation of the shaft 4400 will cause rotational shaft 4600 to rotate. As rotational shaft 4600 rotates, the crankshaft 6000 will convert the rotational motion to an up and down reciprocating motion that moves support shaft 5000 up and down the curved track 2510. This motion will move the blade 7100 up and down the side of a user's face. Referring to FIG. 16, this same process occurs on the opposite side of the apparatus with crankshaft 6100, which converts rotational movement from shaft 4500 to an up and down reciprocal motion of gear 2600 up and down track 2500. As previously described with the other side of the apparatus, as the rotary motor 1110 rotates rotational shafts 4000 and 4100, the beveled gears will cause rotational shaft 4300 to rotate, which will cause rotational shaft 4500 to rotate. Rotary gear 2600 and rotary blade 7000 are also fixed to a spring loaded support rod (not labeled), which is behind the rotary gear 2600 as shown in FIG. 16. Other methods of converting rotational motion to reciprocating motion that are known to one of skill in the art may also be used.

Figure 20:
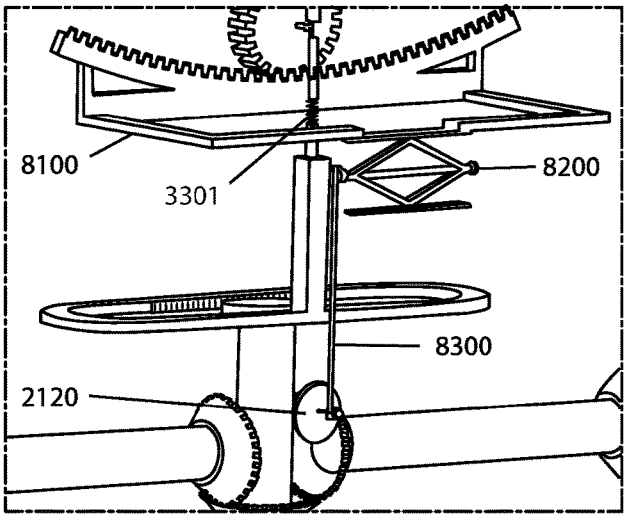
FIG. 20 is a close-up view of one embodiment of the track adjustment mechanism of the facial hair shaving apparatus of FIG. 13.

FIG. 20 is a close-up view of one embodiment of the track adjustment mechanism of the facial hair shaving apparatus. The track adjustment mechanism allows the user to adjust the height and width of the tracks to accommodate different face shapes and sizes. In one embodiment, the track adjustment mechanism may be comprised of an adjustment knob 2120, a platform support 8100 in which the track 2520 sits on, a lift 8200, and a lift rod 8300. The knob 2120 is in communication with the lift rod 8300 via beveled gears and the lift rod 8300 is in communication with the lift 8200 via beveled gears. In one embodiment, the lift may be akin to a scissor jack, wherein rotation at the center cross-section bar of the jack will cause the jack to raise or lower. In use, a user may turn the adjustment knob 2120 clockwise or counter-clockwise, which will cause the beveled gears to rotate the lift rod 8300, which will cause the lift 8200 to raise or lower depending on the direction the user is turning the knob, which will cause the track to raise or lower on support platform 8100. The track adjustment mechanism may also be applied to the side tracks 2500 and 2510, wherein the knobs 2100 and 2110 (See FIG. 23) will adjust the side tracks respectively. Other methods of raising, lowering, widening, or narrowing a track that are known to one of skill in the art may also be used.

Figure 21:
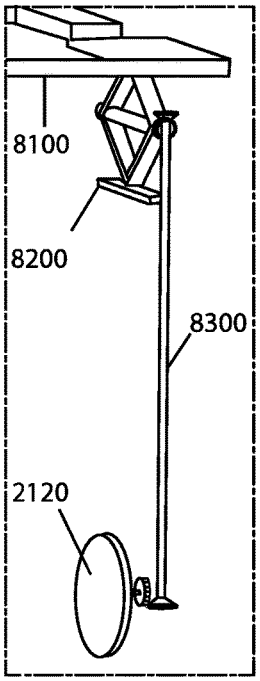
FIG. 21 is another close-up view of one embodiment of the track adjustment mechanism of the facial hair shaving apparatus of FIG. 13.

FIG. 21 is another close-up view of one embodiment of the track adjustment mechanism of the facial hair shaving apparatus. The track adjustment mechanism and corresponding lift 8200 may be of any method of one known in the skill in the art.

Figure 22:
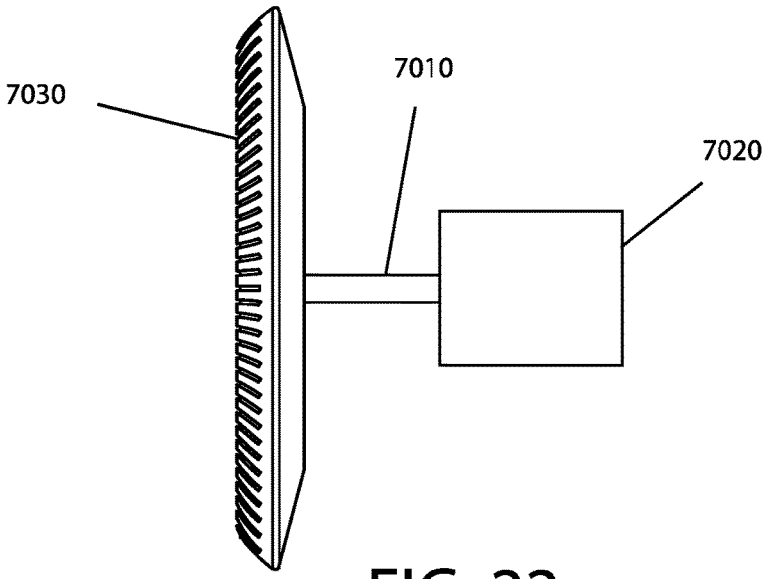
FIG. 22 is a side view of one embodiment of the rotary blades of the facial hair shaving apparatus of FIG. 13; and, FIG. 23 is a perspective view of one embodiment of the rotary blades of the facial hair shaving apparatus of FIG. 13 featuring a protective screen cover.

FIG. 22 is a side view of one embodiment of an exemplary rotary blade of the facial hair shaving apparatus. In one embodiment, the cutting mechanism may be rotary blades 7000, 7100, 7200. Referring to FIG. 22, the rotary blades have a protective screen cover 7030 to protect a user from the blades and the blades may feature a neck 7010 that allows the rotary blade to pivot around the end of the neck 7010, so that the blade can contour with the face. Additionally, in a preferred embodiment, the rotary blades feature micro motors 7020 that are in communication with the rotary blades, which power the rotation of the blades within a rotary blades.

Figure 23:
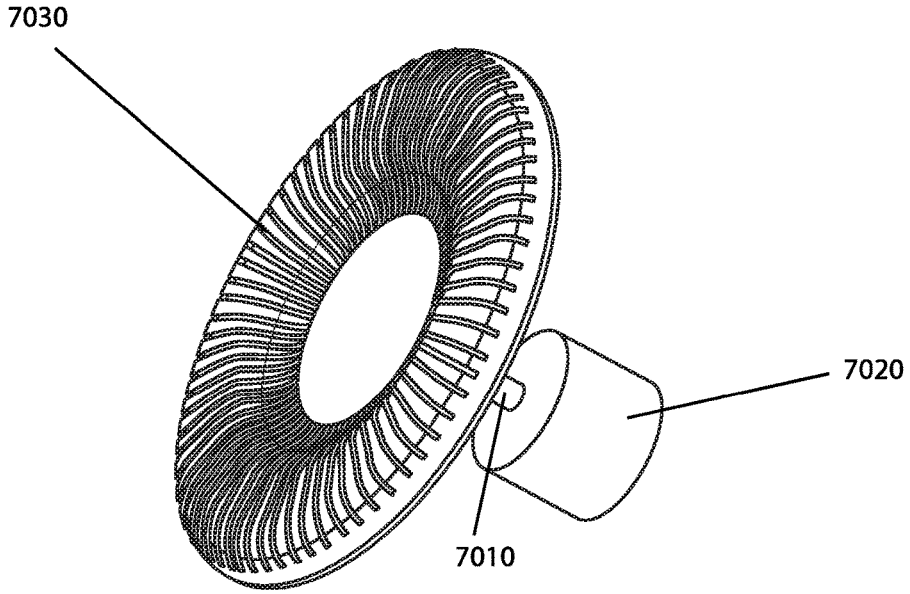

FIG. 23 is a perspective view of one embodiment of the rotary blades of the facial hair shaving apparatus. In an alternative embodiment, the cutting mechanism may be straight blades or lasers.

Accordingly, in use, once the motor 1110 and micro motors 7020 are on, the goatee shaving apparatus will oscillate the rotary blades along the tracks automatically shaving an outline for a goatee. Other methods of moving a blade back and forth along a guided track that are known to one of skill in the art may also be used.

Other assembly methods may be practiced depending on the use of alternative embodiments described herein, and will be readily apparent to those skilled in the art.

I claim:

1. A method of shaving a goatee comprising:

obtaining a facial hair shaving apparatus comprising a canopy and a handle;

wherein a first motor is located in the handle;

wherein a plurality of guiding tracks with blades that are respectively powered by second motors are located within the canopy;

wherein the blades that are respectively powered by the second motors travel on the guiding tracks;

wherein the guiding tracks have track adjustment knobs;

adjusting the guiding tracks on the apparatus, whereby the tracks fit around lips of a user and under a chin of the user;

placing the apparatus around a mouth area of the user, wherein the user's mouth area includes at least a portion of at least one of a nose of the user, the lips, and the chin, wherein the blades are in flush contact with skin of the user, wherein a blade of the blades is located to the left of a user's lips, another blade of the blades is located to the right of a user's lips, and another blade of the blades is located on an underside of the chin of the user;

turning on the first motor, whereby each of the blades will move back and forth along a user's face via a respective one of the guiding tracks, whereby the blades are respectively powered by the second motors to cut the user's hair, whereby the apparatus shaves an outline of a goatee.

2. The method of claim 1, wherein at least one of the blades is a rotary blade.

3. The method of claim 2, wherein at least one of the rotary blades is further defined by a protective cover.

4. The method of claim 1, wherein at least one of the blades is fixed to a spring loaded support shaft.

5. The method of claim 1, wherein the first motor is powered by an electrical outlet.

6. The method of claim 1, wherein the first motor is powered by a rechargeable battery.

7. The method of claim 6, wherein the second motors are powered by the rechargeable battery.

* * * * *